US010267044B2

(12) United States Patent
Lamoureux

(10) Patent No.: US 10,267,044 B2
(45) Date of Patent: Apr. 23, 2019

(54) MODULAR STRUCTURE, MODULE FOR SUCH A MODULAR STRUCTURE AND METHOD FOR THE PRODUCTION OF SUCH A MODULAR STRUCTURE

(71) Applicant: O.PARTICIPATIONS SAS, Paris (FR)

(72) Inventor: Bruno Lamoureux, Bertrange (LU)

(73) Assignee: O PARTICIPATIONS SAS, Paris (FR)

( * ) Notice: Subject to any disclaimer, the term of this patent is extended or adjusted under 35 U.S.C. 154(b) by 0 days.

(21) Appl. No.: 15/561,534

(22) PCT Filed: Apr. 20, 2016

(86) PCT No.: PCT/LU2016/000001

§ 371 (c)(1),
(2) Date: Oct. 16, 2017

(87) PCT Pub. No.: WO2016/163865

PCT Pub. Date: Oct. 13, 2016

(65) Prior Publication Data

US 2018/0066439 A1 Mar. 8, 2018

(30) Foreign Application Priority Data

Mar. 26, 2015 (FR) ..... 15 52531

(51) Int. Cl.
*E04F 13/08* (2006.01)

(52) U.S. Cl.
CPC ..... *E04F 13/0862* (2013.01); *E04F 13/0866* (2013.01)

(58) Field of Classification Search
CPC ..... E04F 13/0862; E04F 13/0866
USPC ..... 52/34, 36.4, 36.5, 384, 385, 424, 426, 52/428, 429, 434, 439, 483.1, 489.1, 52/506.06, 506.09, 561, 562, 568, 582.1, 52/586.1, 585.1
See application file for complete search history.

(56) References Cited

U.S. PATENT DOCUMENTS 1,954,954 A * 4/1934 Shugart ..... E04B 9/24 411/460
3,827,818 A * 8/1974 Ruyters ..... E01C 5/226 404/33

(Continued)

FOREIGN PATENT DOCUMENTS

| | | |
|---|---|---|
| DE | 10 2006 003513 | 8/2007 |
| DE | 10 2008 026169 | 12/2009 |
| WO | 2005/033430 | 4/2005 |

*Primary Examiner* — Brent W Herring
(74) *Attorney, Agent, or Firm* — Clark & Brody

(57) ABSTRACT

Modular structure (1) comprising: —a plurality of modules (2), each module (2) having a basic element (5) comprising a basic body (6) that is identical to the basic bodies (6) of the basic elements (5) of the other modules (2), and a facade element (20) chosen from a range of facade elements that each have different functionalities, the basic element (5) and the facade element (20) of each module (2) being designed to be mounted removably one on the other such that the facade element (20) covers at least a part of a front face (7) of the basic element (5), —a plurality of connectors (30) that are each designed to connect two modules (2) disposed adjacently, each connector (30) having a connector body (31) that is identical to the connector bodies (31) of the other connectors (30).

15 Claims, 7 Drawing Sheets

(56) References Cited

Figure 1:
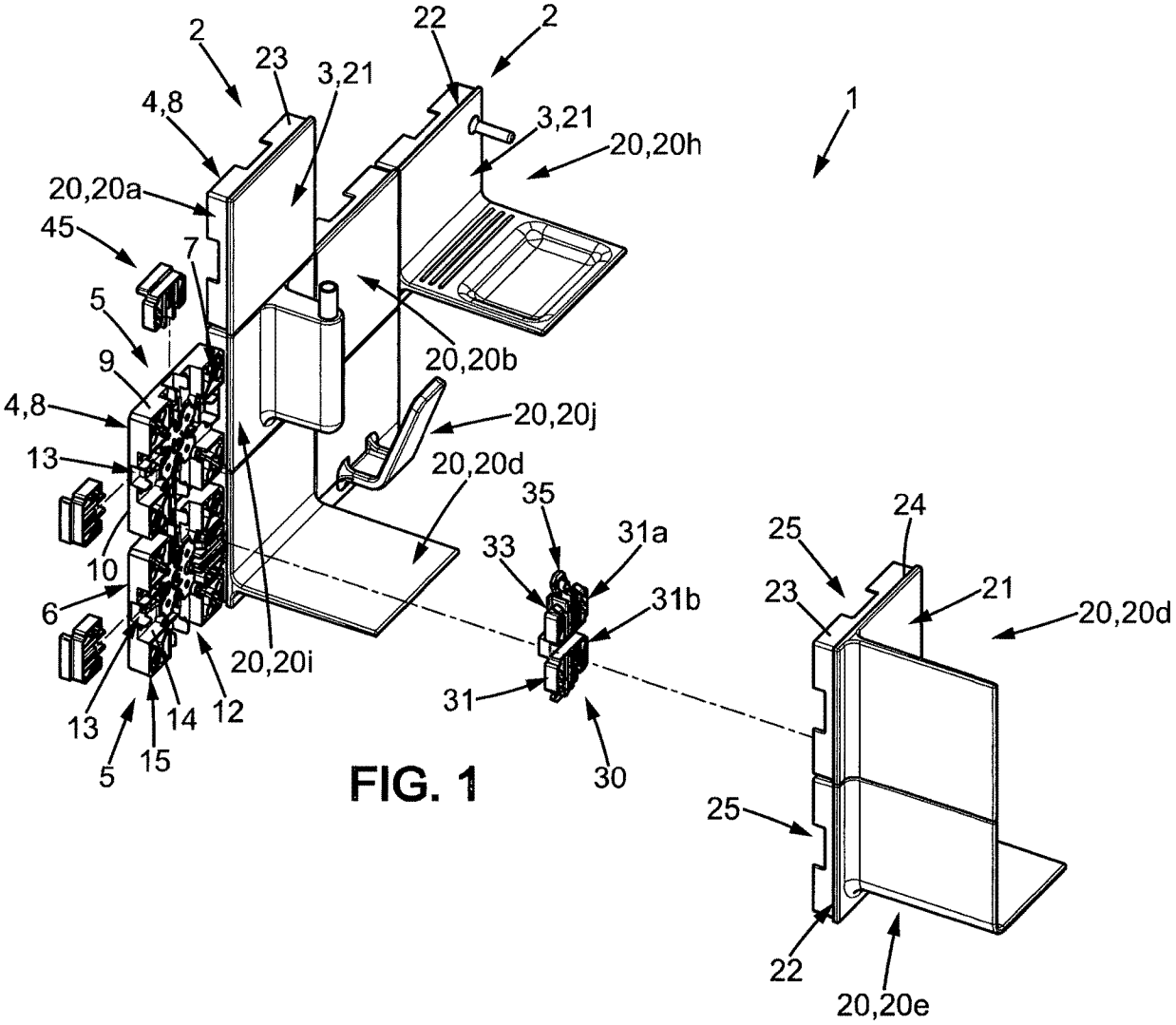

U.S. PATENT DOCUMENTS 4,340,929 A * 7/1982 Konikoff ..... E04B 5/46 362/153
4,876,835 A * 10/1989 Kelley ..... A47B 21/06 52/239
5,038,539 A * 8/1991 Kelley ..... A47B 21/06 211/190
5,459,966 A * 10/1995 Suarez ..... A47K 4/00 4/670
5,616,389 A * 4/1997 Blatz ..... A47G 27/0293 404/36
5,890,325 A * 4/1999 Corcorran ..... A47B 21/00 52/36.1
5,953,878 A * 9/1999 Johnson ..... B63B 5/24 256/19
5,979,118 A * 11/1999 Gortsema ..... A47B 21/00 52/239
6,378,255 B1 * 4/2002 Eich ..... A47B 21/00 40/605
7,174,678 B2 * 2/2007 Gallant ..... A61G 7/00 52/36.1
7,537,030 B2 * 5/2009 Gallant ..... A61G 7/00 141/18
7,621,091 B2 * 11/2009 Dickey ..... E04F 15/02 52/582.2
8,046,968 B2 * 11/2011 Kellner ..... E04C 2/22 52/403.1
8,136,277 B2 * 3/2012 Patterson ..... G09F 9/33 362/147
8,371,076 B2 * 2/2013 Jones ..... F24J 2/5237 126/704
9,151,060 B2 * 10/2015 Khongbantabam ..... E04F 13/0862
9,290,936 B2 * 3/2016 Dickey ..... B32B 37/144
9,879,434 B2 * 1/2018 Boyd ..... H02G 3/385
2005/0005549 A1 * 1/2005 Peter ..... E04B 2/74 52/384
2007/0094998 A1 * 5/2007 Gomez Insa ..... E04F 19/062 52/718.01
2007/0125008 A1 * 6/2007 Gallant ..... A61G 7/00 52/36.4
2009/0133360 A1 * 5/2009 Rippin ..... E04F 13/0835 52/749.11
2009/0313915 A1 * 12/2009 Kellner ..... E04C 2/22 52/105
2015/0107177 A1 * 4/2015 Khongbantabam ..... E04F 13/0862 52/311.2

* cited by examiner

MODULAR STRUCTURE, MODULE FOR SUCH A MODULAR STRUCTURE AND METHOD FOR THE PRODUCTION OF SUCH A MODULAR STRUCTURE

The invention relates to a modular structure, a module for such a modular structure and a method for the production of such a modular structure.

In particular, the invention relates to a modular structure of the type comprising:

a plurality of modules each having opposite front and rear faces, each module comprising an inner housing and at least two lateral openings capable of allowing the inner housing to communicate with an outside of the inner housing, a plurality of connectors each capable of connecting two modules placed adjacently with respective lateral openings facing one another, each connector comprising two fitting parts capable of being respectively received in the inner housings of the two adjacent modules while extending through respective lateral openings of the two adjacent modules.

The known modular structures of this type offer their users the possibility of producing arrangements of identical modules, for example lighting modules in the modular structure described in document US 2010/0118532 A1, according to an arrangement of their choice.

The invention aims to improve the modularity of the known modular structures.

To this end, the invention proposes a modular structure of the aforementioned type in which each connector comprises a connector body identical to the connector body of the other connectors, and in which each module comprises at least one base element comprising a base body identical to the base body of the base elements of the other modules, and a facade element selected from a range of facade elements respectively having different functionalities, the base element having a rear face belonging to the rear face of the module, and a front face opposite to the rear face, the facade element having a front face belonging to the front face of the module, and a rear face opposite to the front face, the base element and the facade element of each module being capable of being mounted removably on one another in such a way that the facade element covers at least a portion of the front face of the base element, the inner housing and the lateral openings being situated between the base element and the facade element.

Thus, the modular structure according to the invention makes it possible for the user to choose not only the arrangement of the modules but also their functionalities. The arrangement and the functionalities can then be modified for example by moving, removing or adding the base elements with respect to one another, or by inverting or replacing the facade elements. The modularity of the modular structure is thereby improved.

The inner housing and the lateral openings can be formed in the base body of the base element. This layout makes it possible to mount and to change the facade elements having different functionalities on the base elements after these base elements have been assembled in an arrangement at the choice of the user.

The plurality of connectors can comprise at least one transmission connector and the plurality of modules comprises at least one reception module, each transmission connector comprising a transmission component mounted on the connector body and capable of transmitting at least one flow, such as an electrical flow, an electromagnetic flow, a fluid flow or a data flow, between a source of the flow and at least one out of one of the transmission connectors and one of the reception modules, each reception module being capable of receiving and making use of the flow.

The functionality of each reception module can then be selected from:

a transmission functionality, the facade element of the reception module comprising, on the front face, at least one of a charging component and a transmission component based on a flow chosen from an electrical flow and an electromagnetic flow transmitted by the transmission connector, a distribution functionality, the facade element of the reception module comprising, on the front face, a component for dispensing a fluid based on a fluid flow transmitted by the transmission connector, a communication functionality, the facade element of the reception module comprising, on the front face, a data communication interface based on a data flow transmitted by the transmission connector.

The transmission component of the transmission connector and the facade element of the reception module can respectively comprise first and second connection elements capable of being in flow communication when the transmission connector is received in the inner housing of the reception module.

The base element of the reception module can comprise an intermediate connection element mounted on the base body and capable of producing at least one of the flow communications chosen from a flow communication between the first and second connection elements of the transmission connector and of the reception module when the transmission connector is received in the inner housing of the reception module, and a flow communication between the first connection elements of two transmission connectors received in the inner housing of the reception module.

The plurality of modules can comprise at least one trim module having a trim functionality, the facade element of the trim module comprising, on the front face, a trim surface.

The plurality of modules can comprise at least one support module having a support functionality, the facade element of the support module comprising front and rear surfaces parallel with one another on the front and rear faces respectively, the facade element of the support module also comprising, on the front face, at least one support surface projecting with respect to the front surface.

In an embodiment, the base element of each module can comprise, on the rear face, a rear surface capable of being in contact with a vertical surface, the base element comprising at least one component for fastening to the vertical surface.

In another embodiment, the base element of each module can comprise, on a lateral face between the front and rear faces, a support surface capable of being in contact with a horizontal surface.

At least one of the modules can comprise a plurality of base elements and a multiple facade element capable of being mounted removably on the plurality of base elements while covering the front faces of said base elements.

The facade elements of at least two modules can have different functionalities.

According to a second aspect, the invention relates to a module for a modular structure such as defined previously, having opposite front and rear faces, and comprising an inner housing and at least two lateral openings capable of allowing the inner housing to communicate with an outside of the inner housing, the module comprising at least one base element that comprises a base body, and a facade element selected from a range of facade elements respectively having different functionalities, the base element having a rear face belonging to the rear face of the module, and a front face opposite to the rear face, the facade element having a front face belonging to the front face of the module, and a rear face opposite to the front face, the base element and the facade element being capable of being mounted removably on one another in such a way that the facade element covers at least a portion of the front face of the base element, the inner housing and the lateral openings being situated between the base element and the facade element, the inner housing being capable of receiving a fitting portion of at least one connector extending through one of the lateral openings in order to connect the module to another module comprising an identical base body and placed adjacently with a lateral opening facing the lateral opening of the module.

According to a third aspect, the invention relates to a method for the production of a modular structure as defined previously, comprising the steps consisting of connecting the modules placed adjacently in pairs with respective facing lateral openings, the fitting parts of each connector being respectively received in the inner housings of two adjacent modules while extending through respective lateral openings of the two adjacent modules.

When the inner housing and the lateral openings are formed in the base body of the base element, the step consisting of connecting the modules can comprise:

forming an arrangement of base elements, the base elements being placed adjacently in pairs with respective facing lateral openings, the fitting parts of each connector being respectively received in the inner housings of two adjacent base elements while extending through respective lateral openings of the two adjacent modules, positioning the arrangement of base elements at a desired location, mounting the facade elements on the base elements.

The method of production can also comprise the steps consisting of:

removing at least one of the facade elements from the base element on which said facade element is mounted, and mounting a new facade element having a different functionality on said base element.

Figure 2:
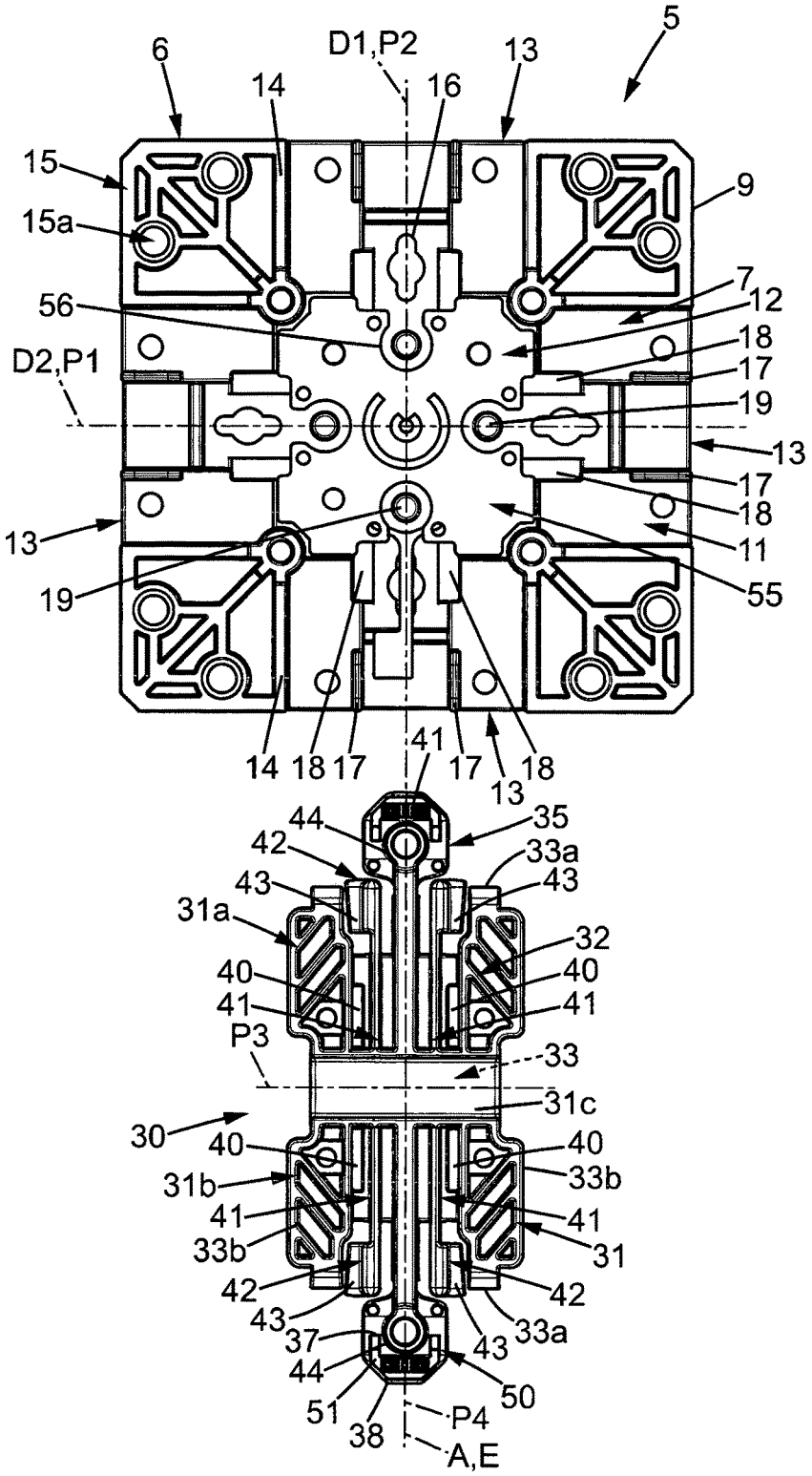
Figure 3:
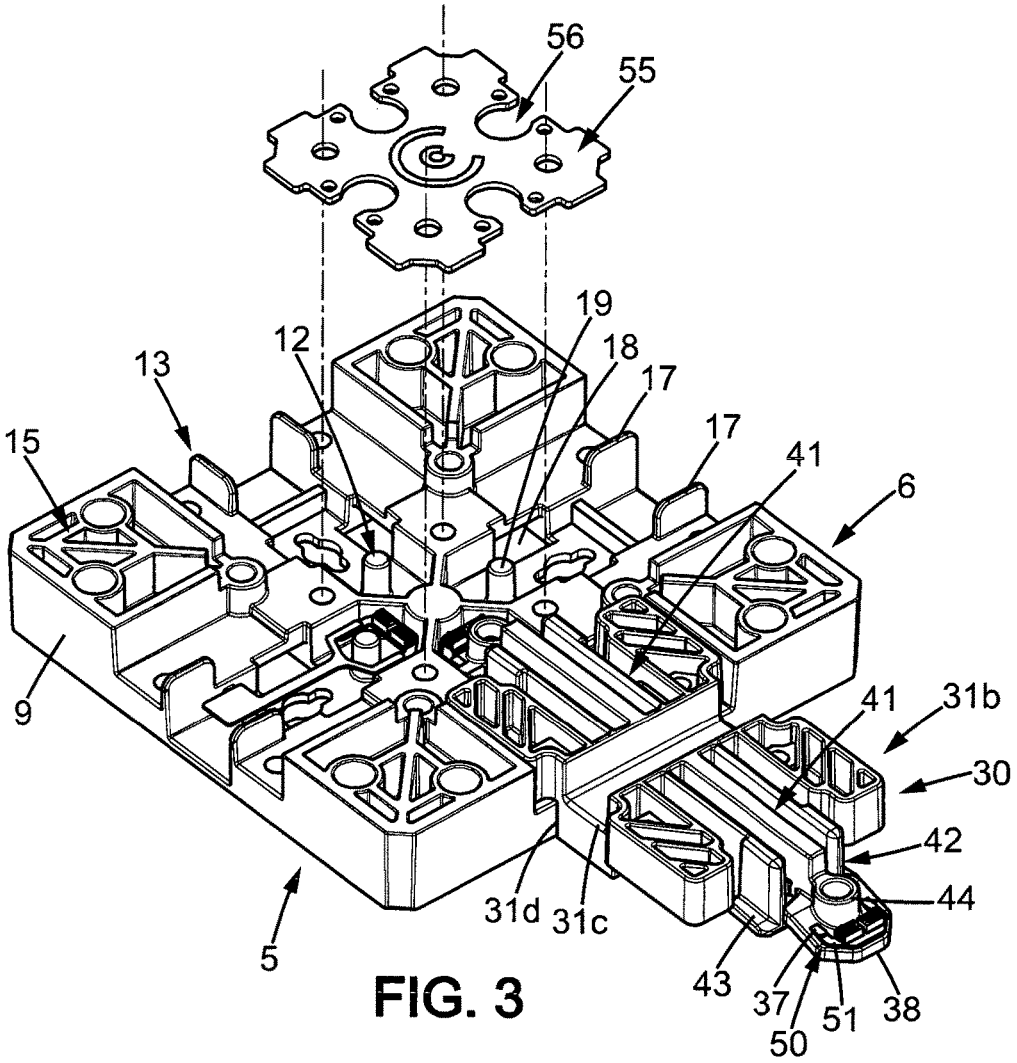
Figure 4:
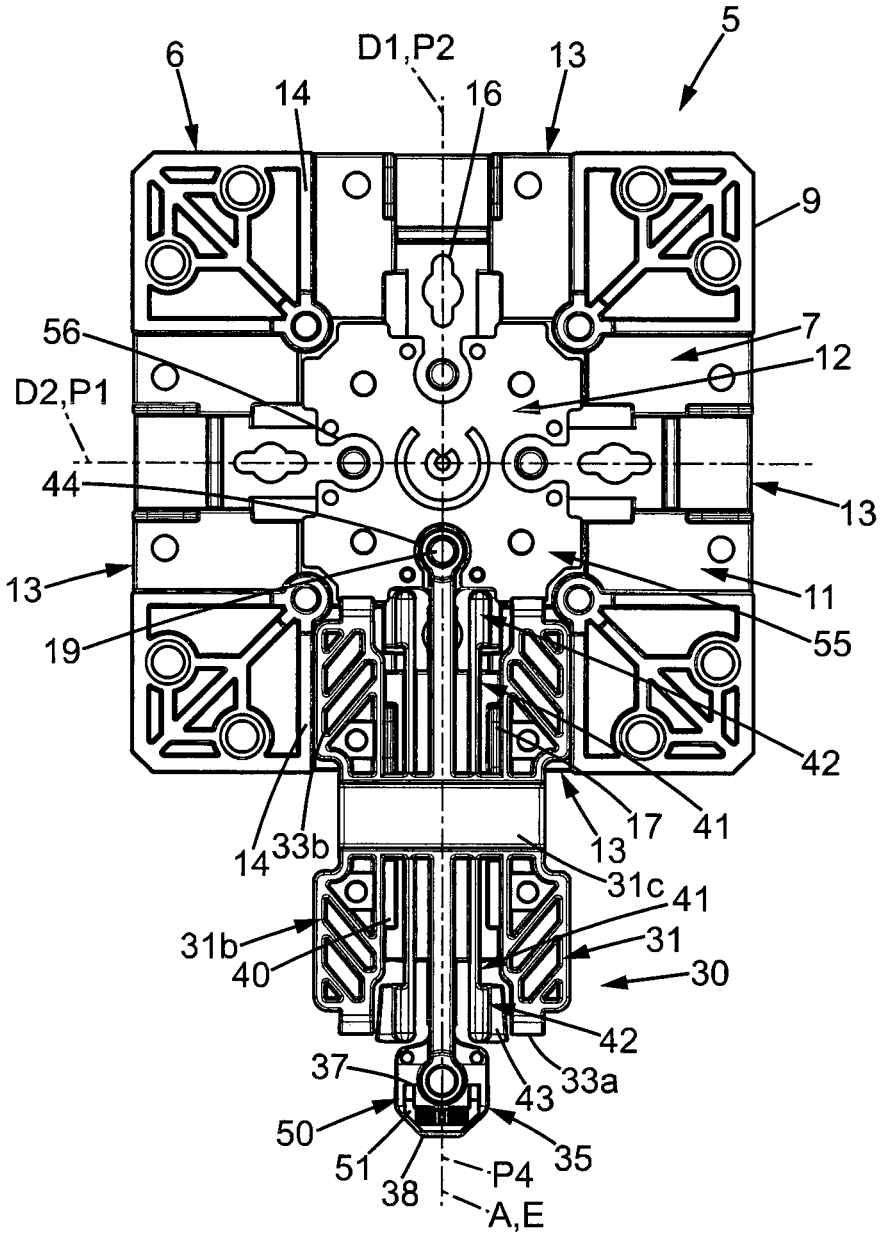
Figure 5:
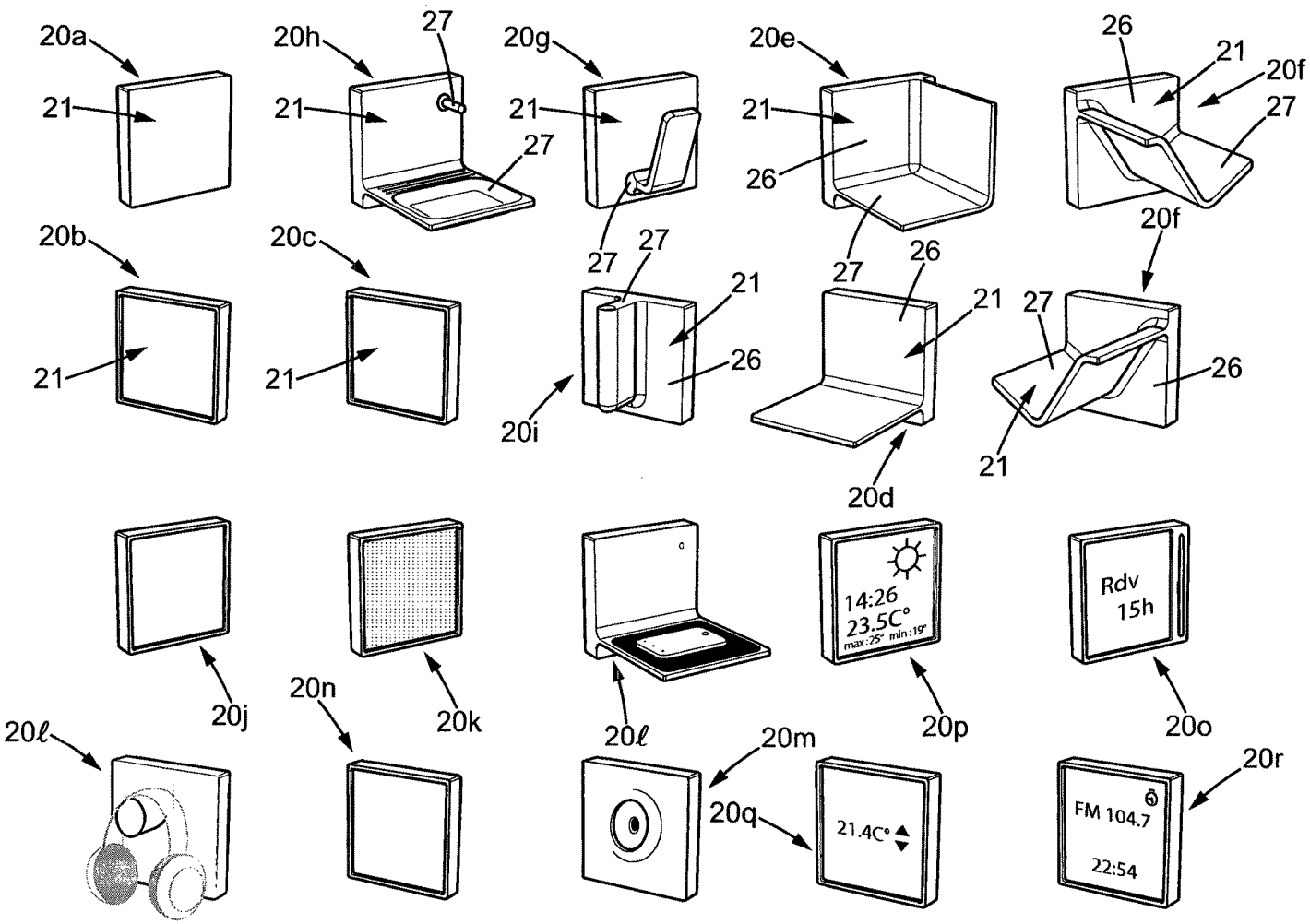
Figure 6:
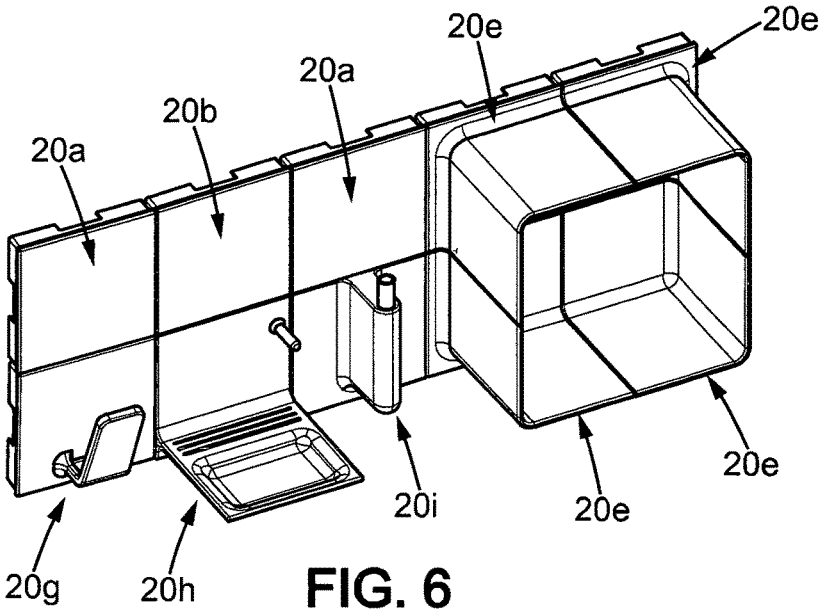
Figure 7:
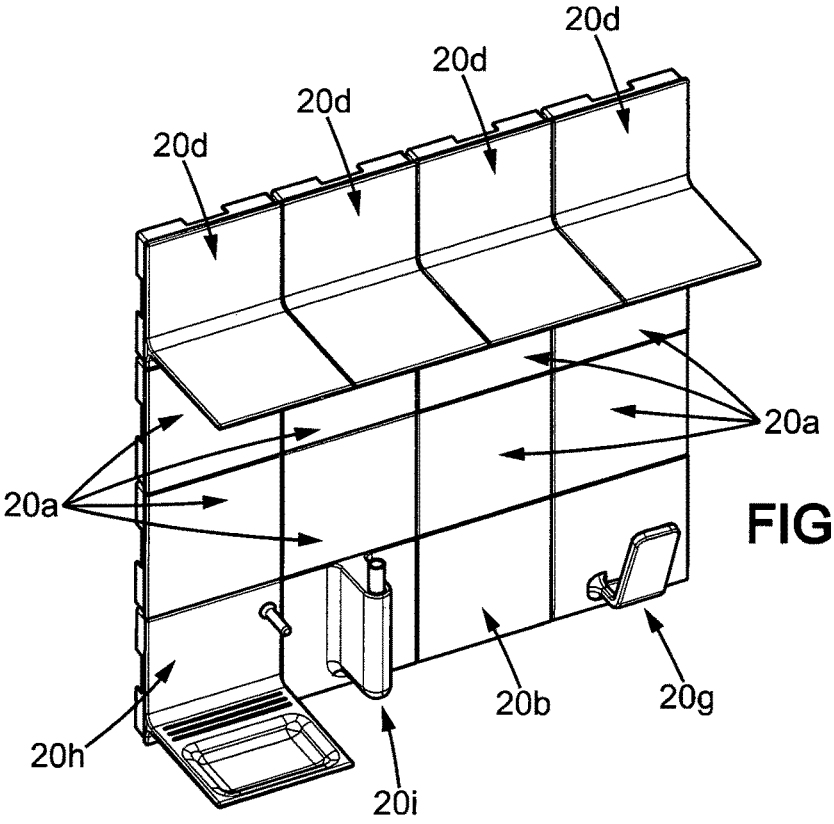
Figure 8:
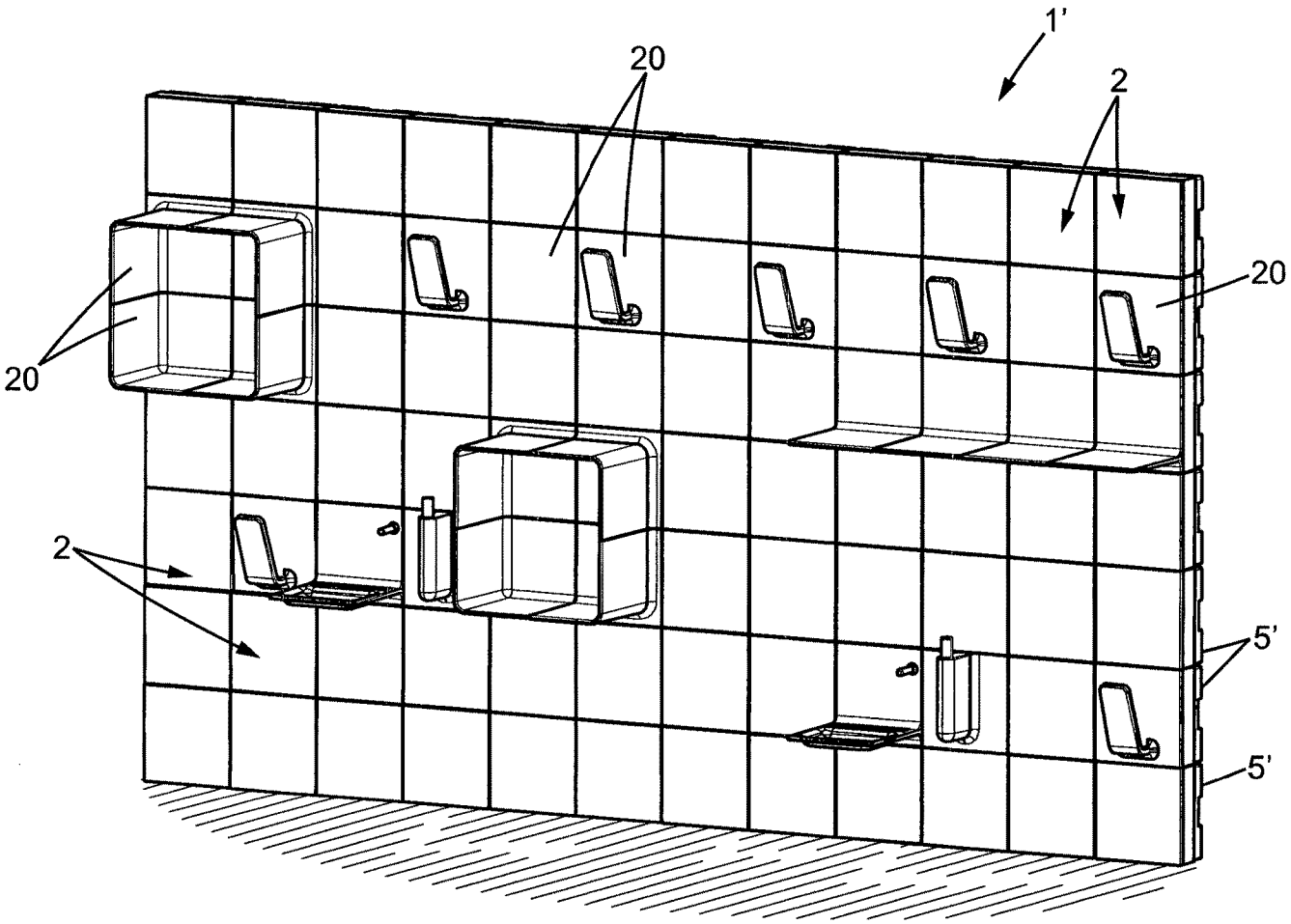

Further aims and advantages of the invention will become apparent on reading the following description of particular non-(imitative embodiments of the invention, the description being given with reference to the attached drawings in which:

FIG. 1 is a perspective view of a modular structure fixed on a vertical surface according to a first embodiment of the invention, the modular structure comprising modules connected in pairs with connectors, the modules each comprising a base element and a facade element mounted removably on the base element, the facade elements having different functionalities, FIG. 2 shows a front face of the base element of one of the modules and one of the connectors of the modular structure in FIG. 1, the base element and the connector comprising connection elements in the form of electrical contacts for transmitting an electrical flow, FIG. 3 is a perspective view of the base element and the connector in FIG. 2, showing the connector received in a housing of the base element and extending through a lateral opening of the base element, the connection element of the base element being shown separately from the base element, FIG. 4 is a plan view of the base element and of the connector in FIG. 2, showing the connector received in the housing of the base element and extending through the lateral opening of the base element, the connection element of the base element being arranged in the housing in order to ensure the transmission of the electrical flow, FIG. 5 shows facade elements having different functionalities, capable of being mounted on the base elements in the modular structure in FIG. 1, FIGS. 6 and 7 show different arrangements obtained based on the modular structure in FIG. 1 to which modules and connectors have been added, facade elements having been replaced by other facade elements having different functionalities, FIG. 8 is a perspective view of a modular structure with modules resting on a horizontal surface according to a second embodiment of the invention.

In the figures, the same references denote identical or similar elements.

FIG. 1 is a perspective view of a first embodiment of a modular structure 1 comprising several modules 2 connected in pairs with connectors 30 in order to form an arrangement.

In the first embodiment, each module 2 comprises on a rear face 4, a base element 5 fixed by any suitable means and in particular by screwing onto a vertical surface, for example a wall, a partition or a door, and on a front face 3 opposite to the rear face 4, a facade element 20 removably mounted on the base element 5.

The base element 5 of each module 2 comprises a base body 6 that is identical for all of the base elements 5 of the modules 2 of the modular structure 1. The base body 6 is made from any suitable material in order to obtain the required shapes and can in particular be produced by moulding from a plastic or composite material.

In the embodiment shown in FIGS. 1 to 4, the base body 6 is constituted by a square plate having on a rear face 8 forming the rear face 4 of the module 2, a front face 7 opposite to the rear face 8 and a peripheral edge 9 between the front 7 and rear 8 faces. The peripheral edge 9 comprises two straight sides distanced from one another in a first direction D1 and two straight sides distanced from one another in a second direction D2.

On its rear face 8, the base body 6 has a flat rear surface 10 suitable for being in contact with the vertical surface.

On its front face 7, the base body 6 has a front surface 11 from which the peripheral edge 9 extends perpendicularly so as to delimit an inner housing 12. The inner housing 12 opens outwards via lateral openings 13 arranged in the peripheral edge 9.

In particular, the peripheral edge 9 is thinned in the middle of each of the straight sides in order to form one of the lateral openings 13. At each corner of the base body 6, two portions of the peripheral edge 9 extending over two adjacent straight sides are extended towards the inside of the base body 6 by an inner wall 14 comprising two right-angle portions in order to form a projection 15 having a square contour. In this way, the inner housing 12 is in the shape of a cross, centred on the base body 6 with four lateral openings 13 arranged in the middle of each of the straight sides of the base body 6. The inner housing 12 thus has a transverse median plane of symmetry P2, perpendicular to the first direction D1 and a longitudinal median plane of symmetry P1, perpendicular to the second direction D2. The median planes of symmetry P1, P2 make it possible for the base body 6 to be left unchanged by a rotation of 90° and to use the base body 6 regardless of its orientation.

In the housing 12, close to each of the lateral openings 13, the base body 6 comprises elements for positioning and holding one of the connectors 30. In the embodiment shown, for each lateral opening 13, the positioning and holding elements comprise two stops 17 extending from the peripheral edge 9, parallel to one another on the front surface 11 on each side of one of the median planes of symmetry P1, P2. They also comprise two through-holes 18 extending respectively parallel to one another in the extension of the stops 17. A cylindrical pin 19 extending from the front surface 11 in one of the median planes of symmetry P1, P2 is also provided close to the centre of the housing 12.

The base body 6 comprises one or more fastening components 16, such as one or more through-holes, making it possible to fix it to the vertical surface.

The facade element 20 also has opposite front 21 and rear 22 faces, between which extends a peripheral skirt 23. The peripheral skirt 23 defines a contour identical to that of the base body 6 of the base element 5, namely here a square contour, in such a way that the facade element 20 can completely cover the front face 7 of the base body 6 with the peripheral skirt 23 of the facade element 20 capping the peripheral edge 9 of the base element 6. The front face 21 of the facade element 20 thus forms the front face 3 of the module 2.

On its rear face 22, the facade element 20 has a rear surface 24 from which the peripheral skirt 23 extends perpendicularly. The peripheral skirt 23 is interrupted in the middle of each of the straight sides of the facade element 20 in order to form a gap 25 capable of being placed in correspondence with one of the lateral openings 13.

The facade elements 20 have functionalities some of which can be identical and others different from one module 2 to another. The facade element 20 is then produced from any material suitable for the functionality that it fulfils. Depending on the functionality, the facade element 20 can be made from plastic or composite material, metal, wood or other. In FIG. 1, the modular structure 1 has, for example, two trim modules 2 having a trim functionality, and six support modules 2 having a support functionality, said trim and support modules 2 will be described hereinafter in relation to FIG. 5.

As previously indicated, for each module 2, one of the facade elements 20 is mounted removably on one of the base elements 5 by fitting one or more male components provided on the facade element 20 into one or more female components 15*a* provided on the base element 5, for example in the projections 15. The facade element 20 completely covers the front face 7 of the base element 5, thus closing the inner housing 12 of the base body 6, and the gaps 25 of the facade element 20 are placed in correspondence with the lateral openings 13 of the base body 6 in order to be able to access the inner housing 12 from the outside.

In a variant, as will become apparent from the following description, the numbers and the arrangements of the base 5 and facade 20 elements, as well as the functionalities of the facade elements 20, may be different from those previously described.

In particular, at least one of the modules may comprise a multiple facade element 20, the dimensions of which are whole multiples of the dimensions of the base element 5 in the first D1 and second D2 directions. The multiple facade element 20 can then be mounted removably on several base elements 5 suitably connected together by connectors 30 so that the multiple facade element 20 may cover the front faces of the base elements 5. The male components for holding the multiple facade element 20 on the base elements 5 can then be removably mounted on the rear face 22 of the multiple facade element 20 so as to be able to modify the arrangement thereof. The male components can in particular be arranged in order to be placed in correspondence with a portion of the set of female components 15*a* of the base elements 5. The user then has the option of converting any device of his choice into a multiple facade element 20 by adding thereto male components arranged in order to cooperate with the female components 15*a* of the base elements 5. In particular, he can convert an ornamental device such as a picture, a frame, a trim plate made of stone, wood or covered with leather or other, or a functional device such as an LCD screen or other, into a multiple facade element 20.

In another variant, the facade element 20 may have smaller dimensions in order to cover only a part of the front face 7 of the base element 5, the front face 3 of the module 2 then comprising the front face 21 of the facade element 20 and a part of the front face 7 of the base element 5.

According to yet another variant, the base 5 and facade 20 elements may have any other contour; polygonal, circular, elliptical or other, with any other arrangement whatever of at least two lateral openings 13 capable of allowing the inner housing 12 to communicate with the outside.

According to a novel variant, the inner housing 12 and the lateral openings 13 may be produced in any other suitable way in order to be located between the base element 5 and the facade element 20: for example, as a first part on the base element 5 and as a second part on the facade element 20, or only on the facade element 20.

Furthermore, in order to hold the facade element 20 on the base element 5, the arrangement of the male and female components may be different and in particular, reversed. Moreover, provision may be made for any other holding system apart from fitting, in particular snap-fitting.

In these variants, the contour of the base body 6 and the arrangement of the lateral openings 13 are nevertheless preferably chosen so that the base body 6 has one or more transverse (i.e. perpendicular to the directions in which the base body 6 extends) median planes of symmetry, leaving it invariant by rotation about a central axis with respect to which the base body 6 extends transversally.

In FIGS. 1 à 4, each connector 30 comprises an identical connector body 31 for all of the connectors 30 of the modular structure 1. The connector body 31 is produced from any suitable material in order to obtain the required shapes and can in particular be produced by moulding from a plastic or composite material.

In particular, the connector body 31 overall has a parallelepiped shape in a direction of extension E and has opposite front 32 and rear 33 faces. The connector body 31 comprises two fitting parts 31*a*, 31*b* on each side of a central portion 31*c*. The central portion 31*c* is offset with respect to the two fitting parts 31*a*, 31*b* in a direction normal to the front 32 and rear 33 faces, so as to have two opposite transverse stop surfaces 31*d* on the rear face 33. The connector body 31 has a transverse median plane of symmetry P3, perpendicular to the direction of extension E and a longitudinal median plane of symmetry P4 extends in the direction of extension E. The fitting parts 31*a*, 31*b* of the connector body 31 are capable of being respectively received in the inner housings 12 of the two adjacent modules 2 by extending through respective lateral openings 13 of the two adjacent modules 2. Similarly to the base body 6, as a result of the symmetry in the transverse median plane of symmetry P3, the connector body 31 can be placed in the housing 12 of the base body 6 in one direction or in the other. On two opposite short sides 33*a*, the connector body 31 comprises respectively two lugs 35 aligned along a central axis A in the direction of extension E. The lugs 35 are inclined with respect to a plane containing the rear face 33 of the connector body 31 and are passed through by a slot 37 close to a free end 38 opposite to the rest of the connector body 31. The base body 31 comprises positioning and holding elements that are complementary to the positioning and holding elements of the base body 6.

In the embodiment shown, the complementary positioning and holding elements comprise two through holes 40 extending parallel to one another from the central portion 31*c*, on each side of the longitudinal median plane of symmetry P4. The through holes 40 are capable of respectively receiving the stops 17 of the base body 6.

The complementary positioning and holding elements also comprise two flexible legs 41 extending parallel to one another from the central portion 31*c*, on each side of the longitudinal median plane of symmetry P4. Each flexible leg 41 has a free end 42 that can be actuated by the user and provided with a horizontal flange 43. The flexible legs 41 are capable of cooperating with the through holes 18 of the base body 6 in such a way that the flanges 43 are in contact with the rear surface 8 of the base body 6 when the free ends 42 are placed in the through holes 18.

The complementary positioning and holding elements finally comprise a projecting cylindrical sleeve 44 on a front face of each of the lugs 35. The cylindrical sleeve 44 is capable of receiving the cylindrical pin 19 of the base body 6.

One of the fitting parts 31*a* of the connector body 31 can be inserted into the inner housing 12 of a module 2 through one of the lateral openings 13 in a direction of introduction normal to the front surface 11 of the base element 5. In particular, the flexible legs 41 of the connector 30 are brought closer to one another in order to make the flanges 43 pass through the through holes 18 of the base body 6. With this, the stops 17 and the cylindrical pin 19 of the base body respectively enter the through holes 40 and the cylindrical sleeve 44 of the connector 30. The dimensions of each fitting part 31*a*, 31*b* of the connector body 31 can then be chosen in order to allow fitting of the long sides 33*b* of the connector body 31 onto the inner walls 14 of the projections 15 of the base body 6. One of the transverse stop surfaces 31*d* of the central portion 31*c* also abuts the peripheral edge 9 of the base body 6. Similarly, the other fitting part 31*b* of the connector body 31 is inserted into the inner housing 12 of an adjacent module 2 through one of the lateral openings 13.

In a variant, each fitting part 31*a*, 31*b* of the container body 31 can be inserted and held in the inner housing 12 in any other suitable way, by adapting the arrangement and the production of the positioning and holding means accordingly.

The modular system 1 also comprises sealing components 45 in the form of caps capable of being inserted into the lateral openings 13 of the base elements 5 that are not used for connection with another base element 5. The caps 45 can thus seal the gaps 25 of the facade elements 20 after they have been mounted on the base elements 5 and ensure a satisfactory finish of the module 2.

FIGS. 2 to 4 show the front faces 32 of a connector 30, called transmission connector, capable of transmitting an electrical flow, and a base element 5 of a module 2 called reception module, capable of receiving and making use of the electrical flow transmitted by the transmission connector 30.

The transmission connector 30 comprises a transmission component 50 mounted on the connector body 31. In particular, the transmission component 50 comprises a first connection element in the form of two electrical contacts 51, made from an electrically conductive material, extending respectively into the slots 37 of the lugs 35 of the connector body 31 in order to rest on the front faces of the lugs 35 close to the free ends 38. The electrical contacts 51 are connected together by any suitable means such as a rod made from an electrically conductive material mounted in the connector body 31, for example in a groove arranged on the rear face 33 of the connector body 31, a cable, a metallic insert, a printed circuit or other.

The base element 5 of the reception module 2 comprises an intermediate connection element in the form of a square printed circuit board 55 on which one or more conductor traces run, and provided with notches 56 on each of its straight sides.

In FIGS. 3 and 4, the printed circuit 55 is mounted in the centre of the inner housing 12 parallel to the front surface 11 of the base body 6 on the transmission connector 30 received in the inner housing 12. The sleeve 44 of one of the lugs 35 of the transmission connector 30 is received in one of the notches 56 of the printed circuit 55 and the corresponding electrical contact 51 comes into contact with one of the traces on an inner surface of the printed circuit 55. Other transmission connectors 30 can be mounted in the other lateral openings 13 of the base element 5 with their electrical contacts 51 in contact with the traces of the printed circuit 55 in order to ensure flow communication between the transmission connectors 30.

The facade element 20 of the reception module 2 then comprises a second connection element produced and arranged in any suitable way in order to be in flow communication with traces of the printed circuit 55 of the base element 5.

The transmission connector 30 can thus transmit the electrical flow from a flow source to the facade element 20 of the reception module 2 and/or to another transmission connector 30 via the base element 5. The transmission connector 30 can be connected to the flow source directly or via one or more transmission connectors 30 and/or one or more base elements 5.

In a variant, the transmission connector 30 and the facade element 20 may be adapted so that the flow can circulate directly from one transmission connector 30 to the other and directly from one transmission connector 30 to the facade element 20 of the reception module 2. The base element 5 of the reception module 2 would then be devoid of any connection element capable of transmitting the flow.

According to another variant, the transmission connector 30 and the reception module 2 may be capable of any type of flow and in particular, complementarily or alternatively to the electrical flow, an electromagnetic flow, a fluid flow or a data flow. One or more corresponding transmission components can then be mounted on the connector body 31 and, if applicable, on the base body 6.

The facade elements 20 can thus be selected from a range of facade elements illustrated non-limitatively in FIG. 5. Each facade element 20 of the range of facade elements has a different functionality from that of the other facade elements 20 of the range.

In particular, as described above, the facade elements 20 can have the trim functionality. The facade element (20) of each trim module (2) comprises a trim surface on the front face (21). The facade element can for example be:

a simple facade element 20*a* having its trim surface produced from a material such as wood, leather, stone or other, coloured or patterned, a mirror facade element 20*b* having a reflective trim surface, or a photo facade element 20*c* having a transparent removable trim surface in order to allow a photo to be installed or removed.

The facade elements 20 can have the support functionality. The facade element 20 of each support module 2 comprises, on its front face 21, a front surface 26 parallel to the rear surface 24 and one or more support surfaces 27 projecting with respect to the front surface 26. In particular, the facade element can be:

a simple shelving facade element 20*d* having the flat support surface 27 perpendicular to the front surface 26 along a straight side of the facade element 20*d*, an angle shelving facade element 20*e* having the angled support surface 27 perpendicular to the front surface 26 along two straight sides of the facade element 20*e*, a V-shaped shelving facade element 20*f* having the angled support surface 27 perpendicular to the front surface 26 and inclined, in one direction or the other, with respect to the straight sides of the facade element 20*f*, a coat rack facade element 20*g* having the support surface 27 on a hook, a valet tray facade element 20*h* having a first support surface 27 on a rod perpendicular to the front surface 26 for example in order to hold keys, and a second support surface 27 perpendicular overall to the front surface 26 and provided with a hollow relief, a facade element 20*i* for holding a single flower, having the cylindrical support surface 27 following an axis parallel to the front surface 26.

Other functionalities can be obtained with the reception modules 2 supplied with a flow.

The reception modules 2 can in particular have an emission functionality. The facade element 20 of the reception module 2 can then comprise, on the front face 21, at least one of a charging component and a light or sound emission component based on a flow chosen from an electrical flow and an electromagnetic flow transmitted by the transmission connector 30. In particular, the facade element can be:

a lighting facade element 20*j* capable of emitting light, a speaker facade element 20*k* capable of emitting sound, a charger facade element 20*l* capable of emitting energy for charging, in particular by induction, a battery or an electrical device such as a mobile phone or an audio headset.

The reception modules 2 can also have a dispensing functionality. The facade element 20 of the reception module 2 can then comprise, on the front face, a component for the dispensing a fluid based on a fluid flow transmitted by the transmission connector 30. The facade element can for example be:

a perfume diffuser facade element 20*m*.

Moreover, the reception modules 2 can have a communication functionality. The facade element 20 of the reception module 2 can then comprise, on the front face 21, a data communication interface based on a data flow transmitted by the transmission connector. The communication interface can in particular comprise an electronic unit for processing data flows connected to an output component, such as a display screen, and, if necessary, an input component, such as a control button or a keyboard. The facade element can for example be:

a digital frame facade element 20*n*, a touch screen facade element 20*o*, a weather station facade element 20*p*, a thermostat facade element 20*q*, an alarm clock-radio facade element 20*r*.

Functionalities other than those described above and shown in FIG. 5 can be provided, in particular a camera module.

With reference to FIGS. 1, 6 and 7, a method for producing a modular structure 1 is described.

In FIG. 1, eight modules 2 are placed adjacently in pairs with respective facing lateral openings 13.

In particular, a user makes an arrangement of his choice with the base elements 5, by placing them adjacently in pairs with respective facing lateral openings 13. The user connects the base elements 5 in pairs by mounting one of the connectors 30 in the lateral openings 13 facing two adjacent base elements 5, each of the fitting parts 31*a*, 31*b* of the connector body 31 extending into the respective inner housings 12 of the two adjacent base elements 5 and being held in the housings 12 as explained previously.

Once the arrangement is thus made, the user can position it in a desired location on the vertical surface, and fasten it.

The user can then select the facade elements 20 from the range of facade elements and place them on the base elements 5. For example, in FIG. 1, the user selects a simple facade element 20*a*, a mirror facade element 20*b*, two simple shelving facade elements 20*d*, an angle shelving facade element 20*e*, a facade element for holding a single flower 20*i*, a coat hook facade element 20*g* and a valet tray facade element 20*h*.

The user can subsequently decide to change the arrangement.

To this end, he can remove, then re-mount the facade elements 20 that he has available by inverting them in order to move the functionalities or replace one or more facade elements 20 by new facade elements 20.

In FIG. 6, the user changes the arrangement in FIG. 1 by adding two modules 2 in order to bring the total number to ten, and by aligning the modules 2 in two rows. In particular, two new angle shelving elements 20*e* are added and the simple shelving facade elements 20*d* of the arrangement in FIG. 1 are replaced by a new angle shelving facade element 20*e* and a simple facade element 20*a*. The angle shelving facade elements 20*e* are oriented in order to form an open box on the front face of the arrangement.

In FIG. 7, the user changes the arrangement in FIG. 6 by adding six modules 2 in order to bring the total number to sixteen, and by aligning the modules 2 in four rows. In particular, six new simple facade elements 20*a* are added and the angle shelving facade elements 20*e* are replaced by four simple shelving facade elements 20*d*.

FIG. 8 shows a perspective view of a second embodiment of a modular structure 1' comprising several modules 2 connected in pairs with connectors in order to form an arrangement.

The modular structure 1' according to the second embodiment differs mainly from the modular structure 1 according to the first embodiment in that the base element 5' of each module 2 comprises, on a lateral face between the front 7 and rear 8 faces, a support surface capable of being in contact with a horizontal surface, such as a floor or a flat surface of an item of furniture.

Each module 2 then comprises a base element 5' of which a thickness between the front 7 and rear 8 faces is greater than that of the base element 5 previously described, so as to allow the base element 5' to be self-supporting. Facade elements 20 can then be removably mounted on each of the front 7 and rear 8 faces of the base element 5'. The base elements 5' can also be connected in pairs with connectors 30 in order to form a partition. The modules 2 and the connectors 30 are capable of having all of the functionalities previously described with reference to the first embodiment of the modular structure 1, including the functionalities involving a transmission of an electrical flow or other.

The description of the base elements 5', the facade elements 20 and the connectors 30 given above in relation to the first embodiment of the modular structure 1 can be directly transposed to this second embodiment of the modular structure 1'. For further detail, reference can therefore be made to the description thereof that has already been given.

The invention claimed is:

1. Modular structure comprising:

a plurality of modules each having opposite front and rear faces, each module comprising an inner housing and at least two lateral openings capable of allowing the inner housing to communicate with an outside of the inner housing, a plurality of connectors each capable of connecting two modules placed adjacently with respective lateral openings facing one another, each connector extending along an extension direction and having opposite front and rear faces, each connector comprising two fitting parts capable of being respectively received in the inner housings of the two adjacent modules while extending through the respective lateral openings of the two adjacent modules, wherein each connector comprises a connector body identical to the connector body of the other connectors, wherein each module comprises at least one base element comprising a base body identical to the base body of the base elements of the other modules, and a facade element selected from a range of facade elements respectively having different functionalities, the base element having a rear face belonging to the rear face of the module, and a front face opposite to the rear face, the facade element having a front face belonging to the front face of the module, and a rear face opposite to the front face, the base element and the facade element of each module being capable of being mounted removably on one another in such a way that the facade element covers at least a portion of the front face of the base element, the inner housing and the lateral openings being situated between the base element and the facade element, wherein each connector comprises a central portion, the fitting parts extending from either sides of the central portion along the extension direction, the central portion being configured to be positioned between the two adjacent modules when the fitting parts are received in the inner housings of said two adjacent modules, the central portion presenting two opposite stop surfaces extending transversely with respect to the extension direction, on the rear face of the connector so as to abut respectively the peripheral edges of the two adjacent modules when the fitting parts are received in the inner housings of said two adjacent modules, and wherein the base body of each module comprises positioning and holding elements, the fitting parts of each connector comprising positioning and holding elements complementary to the positioning and holding elements of the base body.

2. Modular structure according to claim 1, in which the inner housing and the lateral openings are formed in the base body of the base element.

3. Modular structure according to claim 1, in which the plurality of connectors comprises at least one transmission connector and the plurality of modules comprises at least one reception module each transmission connector comprising a transmission component mounted on the connector body and capable of transmitting at least one flow, such as an electrical flow, an electromagnetic flow, a fluid flow or a data flow, between a source of the flow and at least one out of one of the transmission connectors and one of the reception modules, each reception module being capable of receiving and making use of the flow.

4. Modular structure according to claim 3, in which the functionality of each reception module is selected from:

an emission functionality, the facade element of the reception module comprising, on the front face, at least one of a charging component and a transmission component based on a flow chosen from an electrical flow and an electromagnetic flow transmitted by the transmission connector, a distribution functionality, the facade element of the reception module comprising, on the front face, a component for dispensing a fluid based on a fluid flow transmitted by the transmission connector, a communication functionality, the facade element of the reception module comprising, on the front face, a data communication interface based on a data flow transmitted by the transmission connector.

5. Modular structure according to claim 3, in which the transmission component of the transmission connector and the facade element of the reception module respectively comprise first and second connection elements capable of being in flow communication when the transmission connector is received in the inner housing of the reception module.

6. Modular structure according to claim 5, in which the base element of the reception module comprises an intermediate connection element mounted on the base body and capable of producing at least one of the flow communications chosen from a flow communication between the first and second connection elements of the transmission connector and of the reception module when the transmission connector is received in the inner housing of the reception module, and a flow communication between the first connection elements of two transmission connectors received in the inner housing of the reception module.

7. Modular structure according to claim 1, in which the plurality of modules comprises at least one trim module having a trim functionality, the facade element of the trim module comprising, on the front face, a trim surface.

8. Modular structure according to claim 1, in which the plurality of modules comprises at least one support module having a support functionality, the facade element of the support module comprising front and rear surfaces parallel with one another on the front and rear faces respectively, the facade element of the support module also comprising, on the front face, at least one support surface projecting with respect to the front surface.

9. Modular structure according to claim 1, in which the base element of each module comprises, on the rear face, a rear surface capable of being in contact with a vertical surface, the base element comprising at least one component for fastening to the vertical surface.

10. Modular structure according to claim 1, in which the base element of each module comprises, on a lateral face between the front and rear faces, a support surface capable of being in contact with a horizontal surface.

11. Modular structure according to claim 1, in which at least one of the modules comprises a plurality of base elements and a multiple facade element capable of being mounted removably on the plurality of base elements while covering the front faces of said base elements.

12. Modular structure according to claim 1, in which the facade elements of at least two modules have different functionalities.

13. Method for producing a modular structure according to claim 1, comprising the steps consisting of connecting the modules placed adjacently in pairs with respective facing lateral openings, the fitting parts of each connector being respectively received in the inner housings of two adjacent modules while extending through respective lateral openings of the two adjacent modules.

14. Production method according to claim 13, in which the inner housing and the lateral openings of each module are formed in the base body of the base element, and in which the step consisting of connecting the modules comprises:

forming an arrangement of base elements, the base elements being placed adjacently in pairs with respective facing lateral openings, the fitting parts of each connector being respectively received in the inner housings of two adjacent base elements while extending through respective lateral openings of the two adjacent modules, positioning the arrangement of base elements at a desired location, mounting the facade elements on the base elements.

15. Production method according to claim 13, also comprising the steps consisting of:

removing at least one of the facade elements from the base element on which said facade element is mounted, and mounting a new facade element having a different functionality on said base element.

* * * * *